United States Patent [19]

Busta et al.

[11] Patent Number: 4,789,353

[45] Date of Patent: Dec. 6, 1988

[54] ELECTRIC PLUG RETAINER

[76] Inventors: Jeffrey A. Busta, 3610 Valihi Way, Glendale, Calif. 91208; Vincent A. Vinceri, 1825 N. Whitley St., #511, Hollywood, Calif. 90028

[21] Appl. No.: 61,555

[22] Filed: Jun. 15, 1987

[51] Int. Cl.[4] ..... H01R 13/639

[52] U.S. Cl. ..... 439/373

[58] Field of Search ..... 439/367–373

[56] References Cited

U.S. PATENT DOCUMENTS

| | | | |
|---|---|---|---|
| 2,266,560 | 12/1941 | Mansfield | 439/368 |
| 2,569,037 | 9/1951 | Dalton | 439/368 |
| 3,005,176 | 10/1961 | Berg | 439/370 |
| 3,431,537 | 3/1969 | Klingenberg | 439/370 |
| 3,871,731 | 3/1975 | LaCoursiere, Sr. et al. | 439/369 |
| 4,618,200 | 10/1986 | Roberts et al. | 439/367 |

FOREIGN PATENT DOCUMENTS

| | | | |
|---|---|---|---|
| 1152176 | 8/1983 | Canada | 439/373 |

*Primary Examiner*—J. Patrick McQuade
*Attorney, Agent, or Firm*—Harlan P. Huebner

[57] ABSTRACT

An electric plug retainer means to releasably maintain said plug in contact with a wall socket and prevent dislodgment where there is, four double retention, a T shaped bracket mounted to a wall plate that extends outwardly therefrom and there are plug biasing insert means that extends between said plug and bias against a portion of said T shaped bracket to urge the plug into contact with a wall plug. The insert means is adjustable to accommodate plugs of varying lengths.

7 Claims, 2 Drawing Sheets

ELECTRIC PLUG RETAINER

BACKGROUND OF THE INVENTION

1. Field of the Invention

This invention relates to an electric plug retainer which is adopted to releasably lock an electric plug into an electric wall socket or outlet and prevent the same from becoming dislodged.

2. Description of the Prior Art

There have been several attempts to provide some form of structure to prevent an electric plug from becoming dislodged or removed from a wall electrical socket or outlet. However, such devices each possess defects that render them inadequate to properly accomplish the desired result.

With regard to U.S. Pat. No. 2,569,037 which illustrates a lock means for plugs the disadvantage over the present invention is seen in that the locking yokes of the invention are easily removed. In this way children or others can easily unclip the yokes. Further, it appears there is no strong biasing means against the plugs the biasing is not in line but parallel to the axis of the electric plug. Further, the grooves do not appear small enough to assure proper incremental movement of the yokes to assure a tight fit.

In Canadian Pat. No. 1,152,176 the entire unit is cumbersome and it appears the plug holders could again vibrate out of their locking arrangement or be easily removed.

Applicants are also aware of U.S. Pat. No. 4,618,200, however, this retainer system differs from the present invention in that tabs that releasably lock the cover around the plugs are easily distorted to release the cap. In addition, this structure is only useable when there are two plugs of the same height.

SUMMARY OF THE INVENTION

It is a purpose of the present invention to provide an electric plug retainer that is relatively difficult to disengage, yet can be disengaged to unplug the electric plug from an electrical wall outlet.

Another object of the present invention is to provide an electric plug retainer adopted to retain electric plugs of different length against a pair of more of wall outlets covered by a common cover.

A further object of the present invention is to provide an electric plug retainer of such a structure where an electric plug is biased against a wall cover on a wall outlet.

A still further object of the present invention is to provide an electric plug retainer that is light weight and relatively compact so that generally all electric outlet plugs can be accommodated.

Another object of the present invention is to provide an electric plug retainer that employs a bracket that is secured to a wall outlet and an adjustable plug locking means that may bias the plug in its contact position and excess of said locking means may be removed to make disengagement of the plug locking means difficult.

These and other objects and advantages will become apparent from the following part of the specification wherein details have been described for the competence of disclosure, without intending to limit the scope of the invention which is setforth in the appended claims.

BRIEF DESCRIPTION OF THE DRAWING

These advantages may be more clearly understood from the following detailed description and by reference to the drawings in which.

Figure 7:
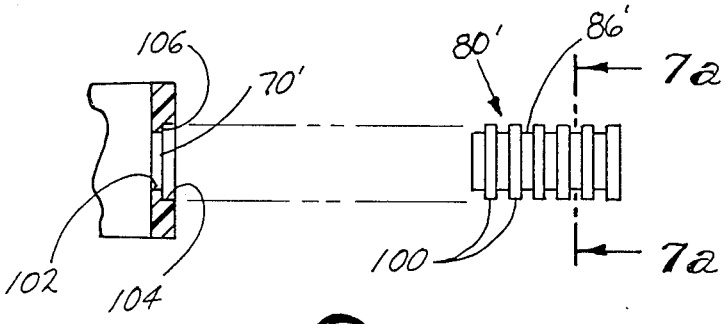
FIG. 7 is an exploded view of a modified form of electric plug retaining means.
Figure 8:
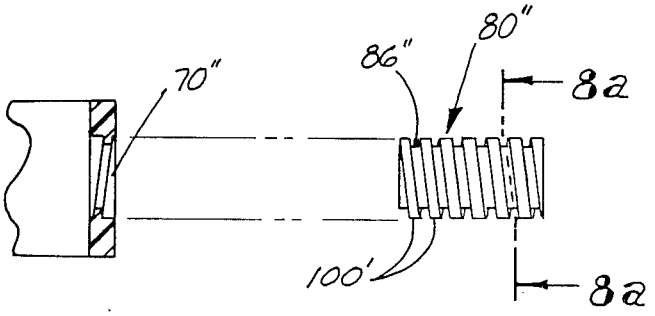

FIG. *7a* is a cross sectional view taken on line *7a—7a* of FIG. 7;

FIG. 8 is an exploded view of another modified form of electric plug retaining means; and FIG. *8a* is a cross sectional view taken on line *8a—8a* of FIG. 8.

DETAILED DESCRIPTION OF THE PREFERRED EMBODIMENT

Figure 1:
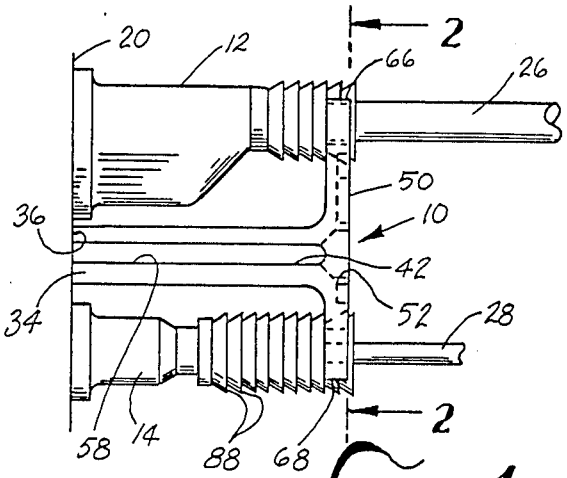
FIG. 1 is a side elevational view of the present invention retaining two electrical plugs of different lengths in a wall outlet.
Figure 2:
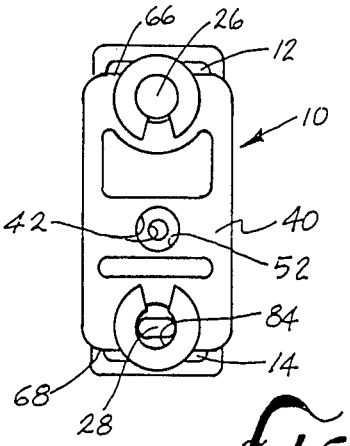
FIG. 2 is end view taken on line 2—2 of FIG. 1.
Figure 3:
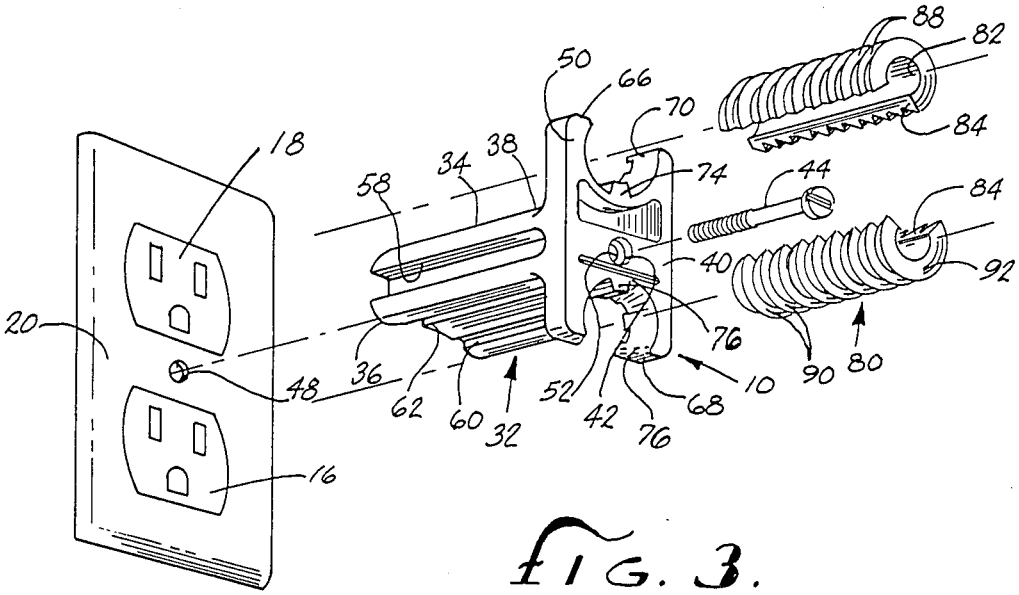
FIG. 3 is an exploded view of the present invention.
Figure 4:
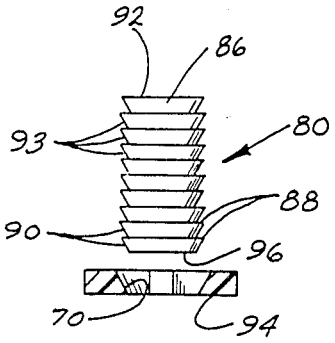
FIG. 4 represents plug locking insert means about to be inserted to retain a plug.

FIGS. 1 and 2 illustrate an electrical plug retainer means generally designated 10 in position retaining a pair of conventional electric plugs 12 and 14 in electrical contact with conventional wall sockets or outlets 16 and 18, see FIGS. 1 and 3, and covered by a conventional electric wall plate 20. The plugs 12 and 14 are illustrated of different shapes and lengths to show that the means 10 is capable of retaining plugs of different length even though mounted in a pair of aligned and connected sockets or outlets.

The electric plugs 12 and 14 each include electric wires 26 and 28 respectively that extend to an electric actuated device not shown.

The electrical plug retainer means 10 preferably includes a plug bias bracket generally designated 32, see FIG. 3. The bracket 32 is "T" shaped and includes a leg 34 which at its end 36 butts against the electric wall plate 20. At the opposite end 38 of leg 34 a bias member or plate 40 projects normal to the axis of the leg 34 preferably on either side of the leg, the bracket forming a "T".

The leg 34 is preferably of a thickness so that when it butts against the plate 20 it will not overlap the pair of electric wall sockets 16 and 18, but will fit between them.

In order to maintain the plug bias bracket 32 to the plate 20 a bore 42 is formed centrally longitudinally through the bias plate 40 and leg 34. An elongated bolt 44 is inserted into the bore 42 and will be threaded through hole 48 in plate 20 into a threaded part of the wall receptacle. At bias plate 40 on top surface 50 there may be formed a counter sink 52 so the bolt head may be recessed.

With the bolt 44 in place the bracket 10 is securely mounted to the plate 20 and will extend outwardly therefrom with the bias plate 40 projecting from the leg 34 parallel yet spaced from the plate 20 on either side of the leg. However, it should be realized that the bracket 32 could be "L" shaped for use with only one electric socket without departing from the spirit of the invention.

For lightness of material and for optimum molding an elongated recess 58 may be formed on each side of the leg 34. In addition, recessess 60 and 62 may be formed in the upper and lower side of the leg 34.

Turning now to the bias plate 40 portion of the bracket means 32, at opposite ends 66 and 68 of the plate there are circular locking cutouts 70 and 72 each have inwardly tapering walls which will be explained. Also in circular configuration each cutout 70 and 72 is more than a half circle or semi-circular, see FIG. 3.

In addition, the cutouts 70 and 72 are each fitted with plug locking means in the form of a tooth 74 and 76 respectively. The teeth 74 and 76 project outwardly from the cutouts 70 and 72.

Adapted to be mounted in each of the cutouts 70 and 72 are plug biasing inserts generally designated 80 which are removable. Each insert is elongated and tubular in nature with a bore 82 extending through a longitudinal axis. Each insert 80 is formed with a longitudinal cut or groove 84 extending from the exterior surface and communicating with bore 82. The grooves 84 are to surround the tooth or projections 74 and 76 and lock the insert means 80 against rotation. Also the grooves 84 are used to pass the wires 26 or 28 into the bore 82.

The exterior surface 86 of each of the plug biasing inserts 80 or 82 are formed with a number of annular locking shoulders 88 by cutting tapered annular walls 90 inwardly from the edge 86 and downwardly from an outer end 92. At the end of each annular tapered wall 90 the shoulder 88 will be formed. In effect there are a number of annular locking shoulders 88 formed by a number of annular tapered walls 90 forming truncated united segments 93.

The taper of each of the cutouts 70 and 72 of the bracket 32 corresponds to the taper of the annular wall 90 of the inserts 82 and 84. Thus, as can be seen in FIGS. 1 and 2 and 4 and 5 when the plugs 12 and 14 are inserted in the wall plug 18 and the bracket 32 is secured against the cover 20 the locking inserts 80 may be positioned with the shoulder 88 bearing against the interior surface 94 of the bias plate.

The grooves 84 are usually of a width so that the cord or wires 26 and 28 may pass through into the bores 82 or 84, see FIG. 2. With the electrical cord 26 or 28 within the insert 80 the insert is urged toward the electric plug 12 until it engages the end thereof. At that point the insert 80 is pressed into the locking cutouts 70 or 72 so that one of the shoulders 90 will engage the interior surface 94 of the bias plate 40. See FIGS. 4 and 5.

As the insert 80 is pressed into the cutout 70 or 72 there is resistance because the actual opening at the outer ends 66 or 68 are of a lesser diameter that the diameter of the exterior surface 86 of the insert 80. Once the insert 80, which is resilient, passes the restrictive opening it will then settle into and conform with the locking cutout at the annular inner end of the tapered wall 90.

Figure 5:
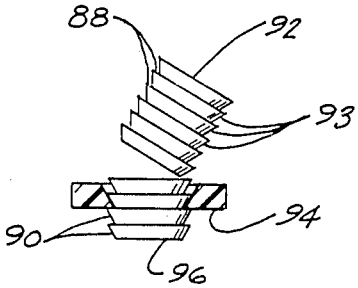
FIG. 5 is similar to FIG. 4 with the plug inserted and the exterior excess removed by being broken off.

The shoulder 88 as best seen in FIGS. 1 and 5 will then bear in-line against the interior surface 94 and act as a stop. In this way it can be seen that the end 96 of the insert 80 will engage the plug 12 and depending on the length of the plug 12 one of the shoulders 88 will engage the plug bias plate 40 locking the plug 12 in place.

In order to prevent unwanted removal of the insert 80 the excess that extends beyond the bracket 32 may be removed such as by cut if off, see FIG. 5.

If it is desired to remove the electric plug 12 then the plug insert 80 may be removed from the locking cutout 70 or 72 by finger pressure or otherwise and the plug 12 or 14 would be free to unplug.

Figure 7A:
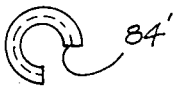

In FIGS. 7 and 7*a* there is illustrated a modified plug biasing insert mean 80' wherein it is elongated and projecting outwardly from the exterior surface 86' are a plurality of annual spaced apart ribs 100. In the case of the locking cutout 70' there is an inner cutout 102 to receive the exterior surface 86' and larger cutout 104 to receive a rib 100. A shoulder 106 between the cutouts acts as a stop against a rib 100 to allow the means 86' to bias against the plug and the bias plate 40.

FIG. 7*a* shows the longitudinal cut or groove 84' for previously described uses.

Figure 8A:
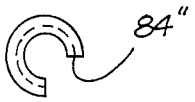

FIG. 8 and 8*a* illustrate another modified plug biasing insert means 80'' wherein it is elongated and projecting outwardly from the exterior surface 86'' are threads 100'. A thread 100' will be pressed into the locking cutout 70'' against shoulder 108.

In FIG. 8*a* the longitudinal cut or groove 84'' is formed for use as previously described.

In view of the fact that the electric plug retainer means 10 is used around electrical outlets it is preferable that the means 10 be molded or otherwise formed of plastic so that the same will not conduct electricity. Further, the use of a plastic material will create a product of lesser weight and easy of manufacture.

Figure 6:
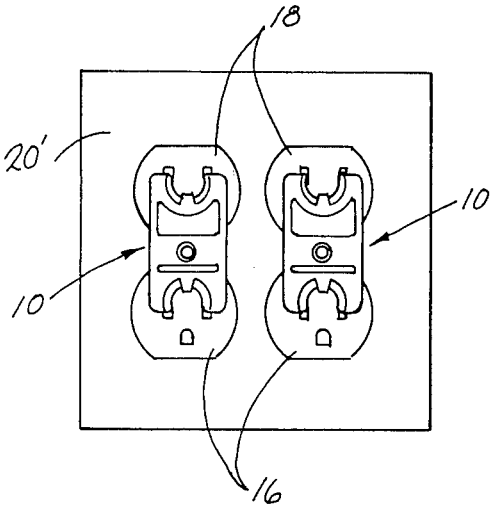
FIG. 6 is an end view of two electric plug retainer means mounted for use with two pair of electric wall sockets having a common cover.

The illustration of FIG. 6 shows two pairs of wall plugs 16 and 18 with an appropriate electric wall plate 20'. Here there are also two electric plug retainer means 10 so that four electric plugs of varying lengths may be used and releasably locks into contact with the sockets 16 and 18.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. We do not wish to be restricted to the specific forms shown or uses mentioned, except as defined in the accompanying claims, wherein various portions have been separated for clarity of reading and not for emphasis.

We claim:

1. An electric plug retainer means to releasably maintain an electric plug with an electric wire extending therefrom in electrical contact with a wall outlet socket covered with an electric wall plate and prevent inadvertent dislodgment of said plug from said wall outlet socket, said combination including:

a unitary plug bias bracket adapted to be attached to said electrical wall plate and extend outwardly of said wall plate, said unitary bracket being T-shaped with the leg of said T secured to said electrical wall plate and a bias member forming the top of said T extending on both sides of said leg generally normal to the axis of said leg, said top forming a pair of bias plates and said bias plates each including a cutout wherein at least one of said cutouts is axially aligned with said outlet socket; and plug biasing insert means removably inserted within said cutout of at least one of said bias plates extending to and bearing against said electric plug, said plug biasing insert being elongated having a longitudinal bore with said electric wire from said electric plug extending through said bore and said bore, said electric plug and said cutout being axially aligned, and said elongated plug biasing insert is laterally shiftable and lockable within said cutout to maintain contact with said electric plug and bias the same against said electric socket.

2. An electric plug retainer means as defined in claim 1 wherein there are two in line electric sockets and a plug biasing means is inserted in each of said cutouts.

3. An electric plug retainer means as defined in claim 1 wherein:

said cut out extends inwardly from an outer edge of said bias plate, is semi circular and is aligned with said wall outlet socket.

4. An electrical plug retainer means as defined in claim 1 wherein said plug biasing insert means is elongated with a plug engaging end and of a circumference to fit within said cutout, said circumference having a plurality of annular stop shoulders of greater circumference than said cutout adopted to abut said bias plate adjacent to said cut out with said plug engaging end in contact with said plug whereby said plug biasing insert is biased between said bias plate and said plug urging said plug into contact with said socket; and said stop shoulders are coaxially aligned one with the other.

5. An electric plug retainer means as defined in claim 4 wherein said cut out includes:

a locking tooth projecting inwardly from said cut out;

said plug biasing insert includes a longitudinal groove extending the length of said insert which groove extends from the exterior of said plug biasing insert communicating with said bore; and said locking tooth is adopted to fit within said groove and prevent turning of said plug biasing insert when in place.

6. An electric plug retainer means as defined in claim 3 wherein:

said bias plate includes outer and inner generally parallel sides and said cut out has an edge which is tapered inwardly from said outer side to said inner side; and said plug biasing insert includes a plurality of coaxial annular truncated united segments that have a taper corresponding with said tapered edge of said cut out and each having an annular segment that is inserted within said cut out and one of said annular shoulders bears against said inner side of one of said bias plates.

7. An electric plug retainer means as defined in claim 6 wherein:

excess coaxial annular truncated united segments projecting outwardly beyond said outer side of said bias plate are adopted to be removed.

* * * * *